US007788958B2

(12) United States Patent
Heinz

(10) Patent No.: US 7,788,958 B2
(45) Date of Patent: Sep. 7, 2010

(54) ROLL FORMER WITH ALIGNED HYDRAULIC FORMER

(75) Inventor: Richard D. Heinz, Grand Haven, MI (US)

(73) Assignee: Shape Corporation, Grand Haven, MI (US)

( * ) Notice: Subject to any disclaimer, the term of this patent is extended or adjusted under 35 U.S.C. 154(b) by 719 days.

(21) Appl. No.: 11/697,372

(22) Filed: Apr. 6, 2007

(65) Prior Publication Data

US 2008/0141749 A1 Jun. 19, 2008

Related U.S. Application Data

(60) Provisional application No. 60/869,826, filed on Dec. 13, 2006.

(51) Int. Cl.
*B21D 5/08* (2006.01)
*B21D 5/14* (2006.01)

(52) U.S. Cl. ..... 72/181; 72/179

(58) Field of Classification Search ..... 72/177, 72/176, 179, 181, 206, 225, 128–131, 404, 72/405.01, 405.05, 405.06
See application file for complete search history.

(56) References Cited

U.S. PATENT DOCUMENTS

| | | | | |
|---|---|---|---|---|
| 2,153,524 | A | 4/1939 | Schmidt | |
| 2,643,863 | A | 6/1953 | Buschow | |
| 3,270,541 | A | 9/1966 | Tishken | |
| 3,797,428 | A | 3/1974 | Nordgren et al. | |
| 3,888,099 | A | 6/1975 | Allen | |
| 3,986,470 | A | 10/1976 | Berry et al. | |
| 4,027,517 | A | 6/1977 | Bodnar | |
| 4,246,737 | A | 1/1981 | Eiloart et al. | |
| 4,471,641 | A | 9/1984 | Mitchell | |
| 4,553,418 | A | 11/1985 | Stoehr et al. | |
| 5,402,572 | A * | 4/1995 | Schulte et al. | 29/897.1 |
| 6,957,558 | B1 * | 10/2005 | Chuang | 72/177 |
| 6,997,026 | B2 | 2/2006 | Fischer | |
| 2005/0241152 | A1 | 11/2005 | McNulty et al. | |
| 2006/0059808 | A1 | 3/2006 | Nguyen | |
| 2007/0074556 | A1 * | 4/2007 | Heatherington | 72/177 |

* cited by examiner

*Primary Examiner*—Edward Tolan
*Assistant Examiner*—Mohammad Yusuf
(74) *Attorney, Agent, or Firm*—Price, Heneveld, Cooper, DeWitt & Litton, LLP

(57) ABSTRACT

An apparatus includes a roll former for forming a continuous beam from sheet material, and a downstream former positioned in-line and downstream of the roll former. The downstream former includes a die-supporting sled temporarily movable with the beam, and includes a bottom die, side dies reciprocatingly movable inwardly to temporarily support sides of the beam, and a top die reciprocatingly movable to reform flanges on the beam against the side dies to reform portions of a section of the continuous beam. A related method is also shown.

19 Claims, 6 Drawing Sheets

ROLL FORMER WITH ALIGNED HYDRAULIC FORMER

This application claims benefit under 35 U.S.C. §119(e) of provisional application Ser. No. 60/869,826, filed Dec. 13, 2006, entitled ROLL FORMER WITH ALIGNED HYDRAULIC FORMER, the entire contents of which are incorporated herein in their entirety.

BACKGROUND

The present invention relates to roll former apparatus with in-line transverse forming capability.

Stamping presses can produce complex parts with multiple hits, but the handling of parts between hits is expensive and leads to slow cycle times. Further, multiple dies and presses are required. Progressive dies can be used in stamping presses to form complex parts. However, progressive dies are expensive to develop, build, and maintain. These expenses increase with increased size and complexity of the component being produced. Roll formers can produce large parts at relatively low cost and at high speed, but are generally limited to producing a continuous cross-sectional shape. Further, a single roll-forming line is typically not able to make both right-hand (RH) and left-hand (LH) parts where the RH and LH parts are non-symmetrical in cross section and length.

It is desirable to take advantage of a roll former's ability to mass produce large parts at low cost, while still being able to produce a structural beam having non-uniform cross-sectional shapes. Thus, an apparatus and method having the aforementioned advantages and solving the aforementioned problems are desired.

SUMMARY OF THE PRESENT INVENTION

In one aspect of the present invention, an apparatus comprising a roll former including rollers configured to form a sheet of material into a continuous beam having a channel-shaped cross section defined by walls and flanges. The apparatus further comprises a downstream former positioned in-line and downstream of the roll former. The downstream former includes a die-supporting sled reciprocatingly movable a distance along with the beam, and includes on the sled a bottom die supporting a bottom of the beam, side dies reciprocatingly movable inwardly toward the beam to temporarily support sides of the beam, and at least one top die reciprocatingly movable downwardly to engage at least one of the walls and the flanges against one or both of the side dies and the bottom die to reform portions of a section of the continuous beam.

In another aspect of the present invention, an apparatus includes a coil reeler, a roll feeder for receiving sheet material from the coil reeler, and a pre-pierce press for piercing apertures into the sheet coming from the roll feeder. The apparatus further includes a roll former incorporating rollers configured to form the sheet coming from the pre-pierce press into a continuous beam having a continuous cross section, and a downstream former positioned in-line with the roll former. The downstream former includes a first die supporting a center of the beam, side dies reciprocatingly movable inwardly along a first direction toward the beam to temporarily support sides of the beam, and a top die reciprocatingly movable along a perpendicular second direction to press the continuous beam selectively against the side dies to reform a section of the continuous beam.

In yet another aspect of the present invention, a method includes steps of uncoiling a sheet of material, pre-piercing the uncoiled sheet, and rollforming the pre-pierced uncoiled sheet with rollers into a continuous beam having a continuous cross section. The method further includes providing a downstream former positioned in-line with the roll former, and reforming the pre-pierced uncoiled sheet using the downstream former including supporting a center of the beam, reciprocatingly moving side dies inwardly along a first direction toward the beam to temporarily support sides of the beam, and reciprocatingly moving a second die along a perpendicular second direction to press the continuous beam selectively against the side dies to reform a section of the continuous beam.

These and other aspects, objects, and features of the present invention will be understood and appreciated by those skilled in the art upon studying the following specification, claims, and appended drawings.

DETAILED DESCRIPTION OF PREFERRED EMBODIMENTS

It is noted that the present description uses the words "up", "down", and the like to facilitate describing the present apparatus. However, these words of direction are not intended to unnecessarily limit the present inventive concepts, but instead are intended only to facilitate the present description. For example, it is contemplated that the present inventive concepts also extend to a similar arrangement where the illustrated downstream former is positioned at a positioned rotated 90 degrees (or more or less) about a longitudinal axis defined by the roll former. It is further contemplated that the first and second banks of dies in the downstream former (and additional banks of dies in the downstream former) can be positioned at different rotated angles, if desired.

Figure 1:
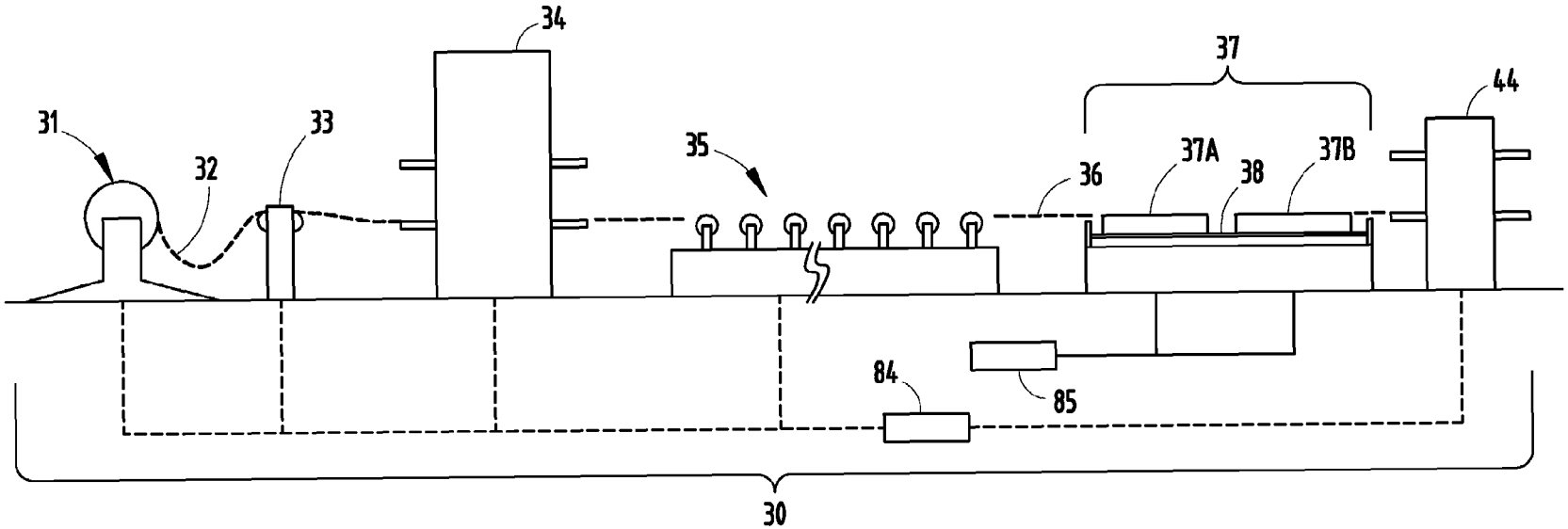
FIG. 1 is a side elevational view of a roll former with aligned hydraulic former downstream of the roll former.
Figure 2:
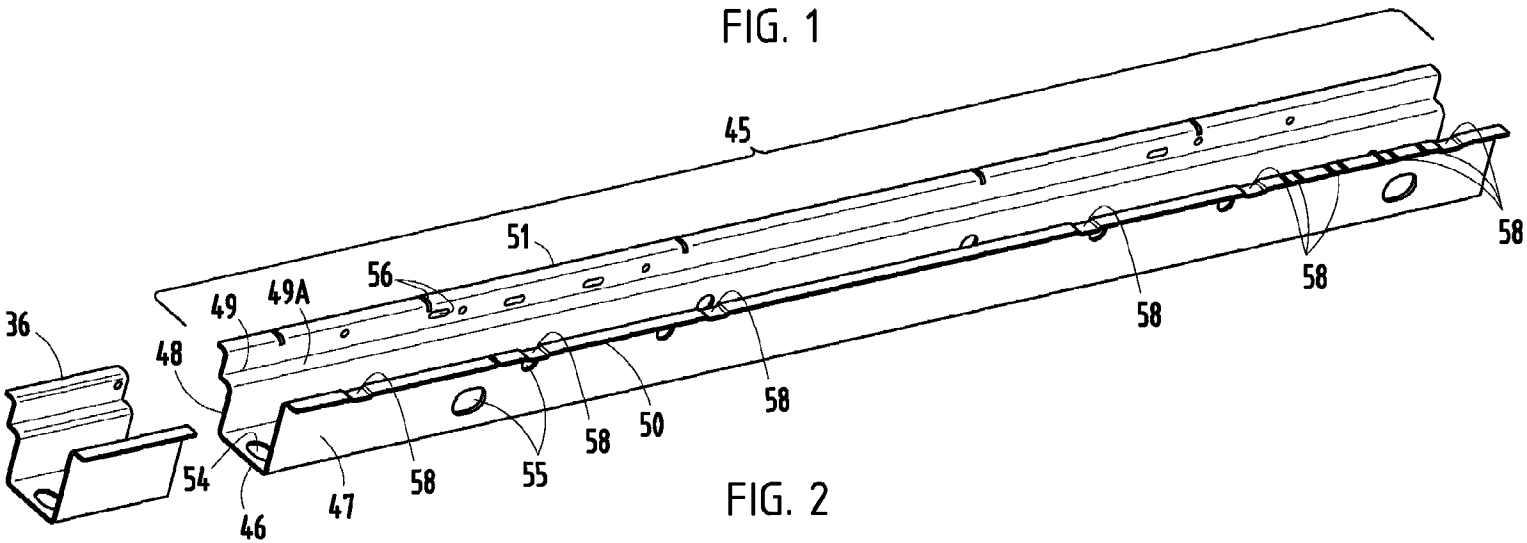
FIG. 2 is a perspective view of a finished structural beam made by the apparatus of FIG. 1.
Figure 3:
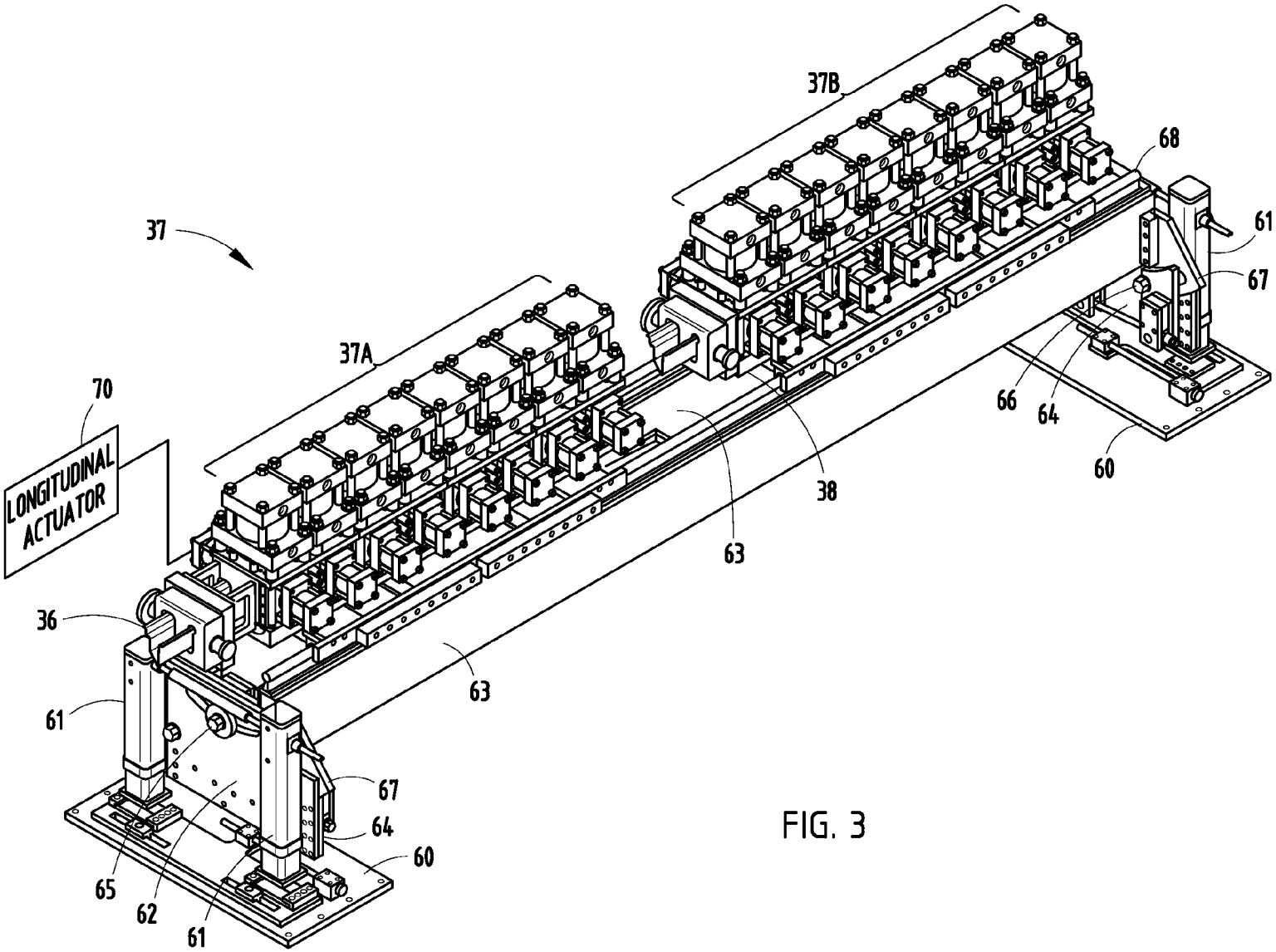
FIG. 3 is a perspective view of the hydraulic former shown in FIG. 1.
Figure 7:
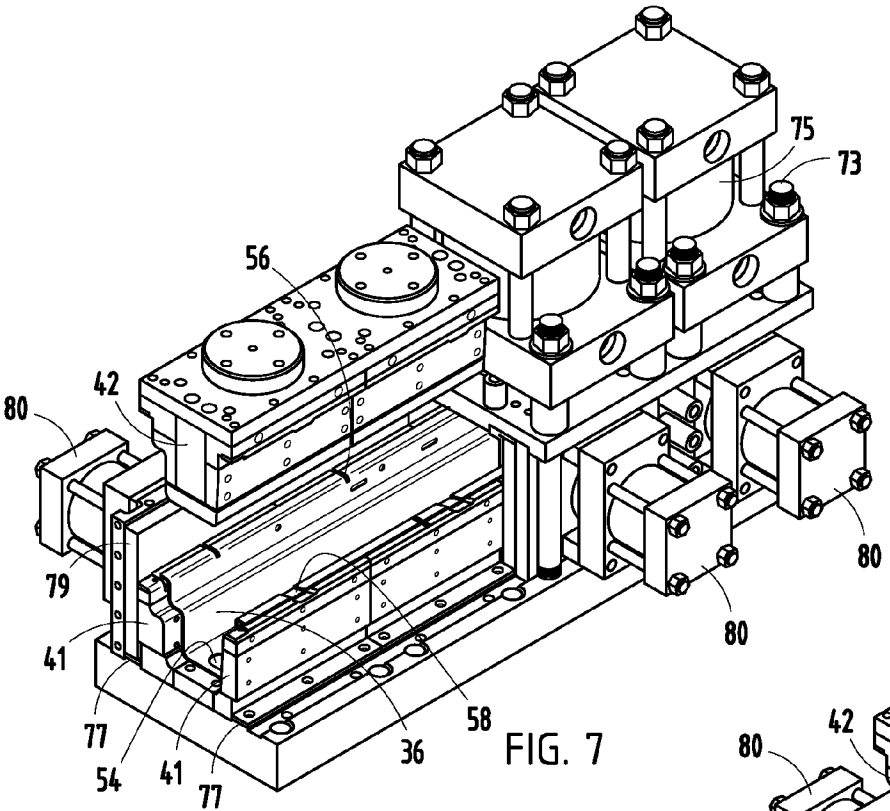
FIG. 7 is similar to FIG. 6, but with the upper die exploded away to expose a part therein, FIG. 8 being the same as FIG. 7 but without the part.

An apparatus 30 (FIG. 1) includes a coil reeler 31 supporting a roll of sheet material 32, a roll feeder 33 for receiving the sheet material 32 from the coil reeler 31, and a pre-pierce press 34 for piercing apertures into the sheet material 32. The sheet material 32 is then fed to a roll former 35 for forming a continuous beam 36, and then to a downstream former 37 positioned in-line and downstream of the roll former 35. The downstream former 37 includes die-supporting sleds 38 (two illustrated in FIG. 3) selectively movable on tracks with the continuous beam 36 to reform sections of it. The reformer 37 includes a bottom die 40 (FIG. 7), hydraulically operated side dies 41 reciprocatingly movable inwardly to temporarily support sides of the beam 36, and hydraulically operated top dies 42 reciprocatingly movable to engage edge flanges on the continuous beam 36 against the side dies 41 to reform portions of a section of the continuous beam 36. The continuous beam 36 is then cut by a cut off press 44 (FIG. 1) to form structural beams 45 (FIG. 2). By selectively actuating a first bank 37A or a second bank 37B of the dies in the reformer 37, right- and left-handed versions of the structural beam 45 can be made. Specifically, the right-handed beam 45 is shown. The left-handed version uses a same cross section, but with the holes and apertures formed by the pre-pierce press 34 formed in a longitudinally reversed sequence and with the depressions in flanges also formed in a longitudinally reversed sequence, as described below.

The illustrated structural beam 45 (FIG. 2) is a generally "U" channel, with a bottom wall 46, planar side wall 47, non-planar side wall 48 with bends 49-49A, and flanges 50 and 51 extending from the side walls 47, 48, respectively. Apertures 54-56 are formed in the walls and flanges 46-51 by the pre-pierce press 34. The channel with walls and flanges 46-51 is formed by the roll former 35, and the holes and apertures are formed by the pre-pierce press 34. The reformer 37 forms depressions 58 in flanges 50-51. By selectively forming the apertures 54-56 and depressions 58, one structural beam 45 is formed. The illustrated structural beam 45 has a non-uniform cross section and also is non-uniform along its length. The illustrated structural beam 45, made by using the bank 37A of the reformer 37, is for use along a right-handed part for a vehicle frame. The apparatus 30, by operating the bank 37B of the reformer 37, is also configured to make a left-handed structural beam that is a (longitudinal) mirror image of beam 45, but with apertures and depressions in mirrored opposite positions.

The reformer 37 (FIG. 3) includes a main frame including at each end a base 60, standards 61 adjustably mounted on base 60, and a stationary cross plate 62. A subframe for carrying the sled 38 includes a pair of longitudinally-extending support beams 63 with transverse end plates 64. End plates 64 are rotatably adjustably supported by stationary cross plates 62 by pivot pins 65, and can be locked in a selected angular position by clamps 66 and lateral locking plates 67. This allows the sled 38 to be angularly, horizontally and vertically adjusted to match the continuous beam 36 coming from the roll former 35. Tracks 68 are attached atop the support beams 63, and sled 38 includes bearings 69 that slidably engage the tracks 68. An actuator 70 (schematically shown, but which can be hydraulic, electrical or other) returns the 38 in an upstream direction after its reforms the continuous beam 36. It is noted that the sled 38 may be moved in a downstream direction by the force of the moving continuous beam 36 (motivated by the roll former 35) or can be motivated (or assisted) in the downstream direction by the actuator 70.

Figure 4:
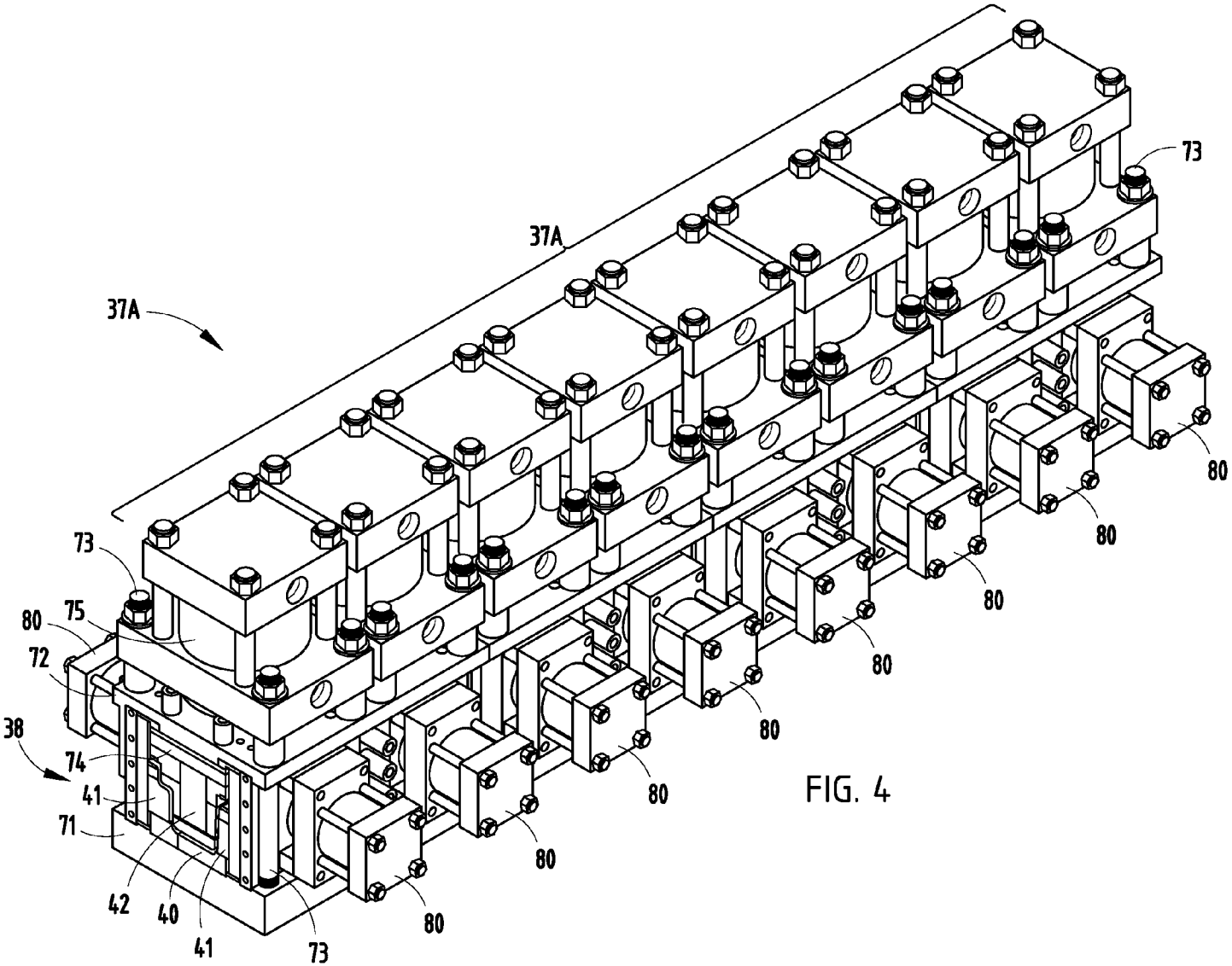
FIG. 4 is an enlarged perspective view of half of the hydraulic former.

The sled 38 (FIG. 4) includes a bottom plate 71 on which is mounted the bottom die 40. Four tie rods 73 extend to top plates 72. An intermediately-positioned movable platen 74 is mounted on the tie rods 73 and a hydraulic actuator 75 is operably attached to the top plate 72 to motivate the movable platen 74. The top die 42 is attached to the movable platen 74. It is noted that there are a plurality of the components 72-75 arranged along a length of the sled 38 in two banks, one bank 37A being for forming a right-handed part and the other bank 37B being for forming a left-handed part. (See FIGS. 1 and 3.) It is also noted that the top dies 42 and top plates 74 can extend the length of a single movable platen 74, or can extend two platens 74 in length, or can extend still further in length, depending on the functional requirements of the system.

Figure 6:
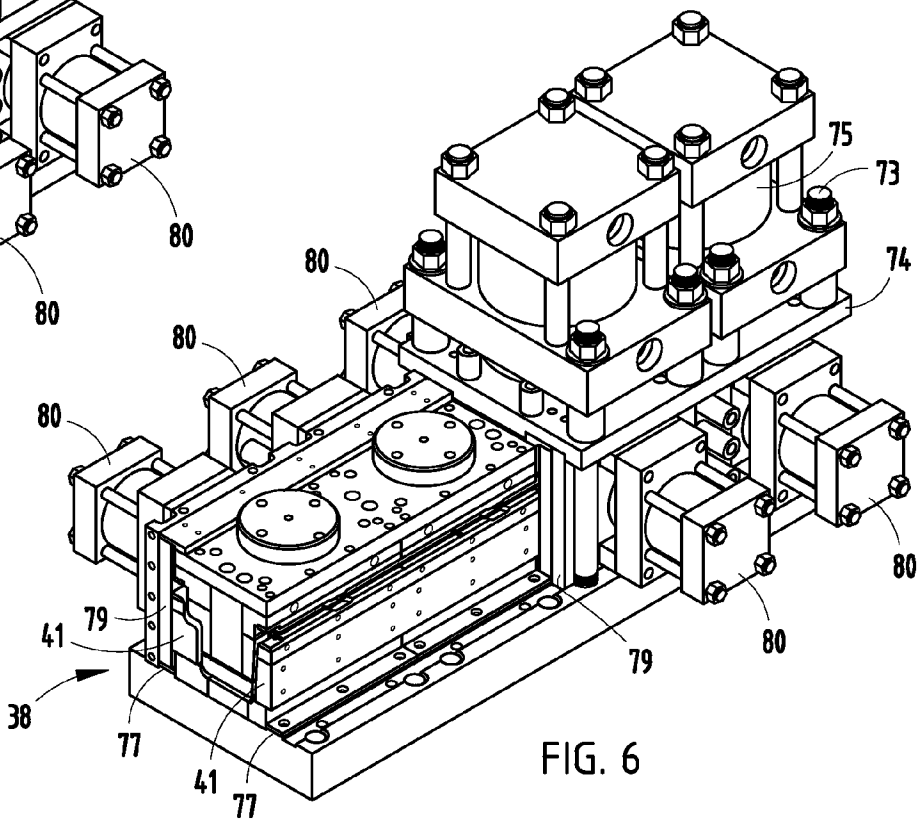
FIG. 6 is similar to FIG. 5, but with the first two top hydraulic actuators removed.
Figure 5:
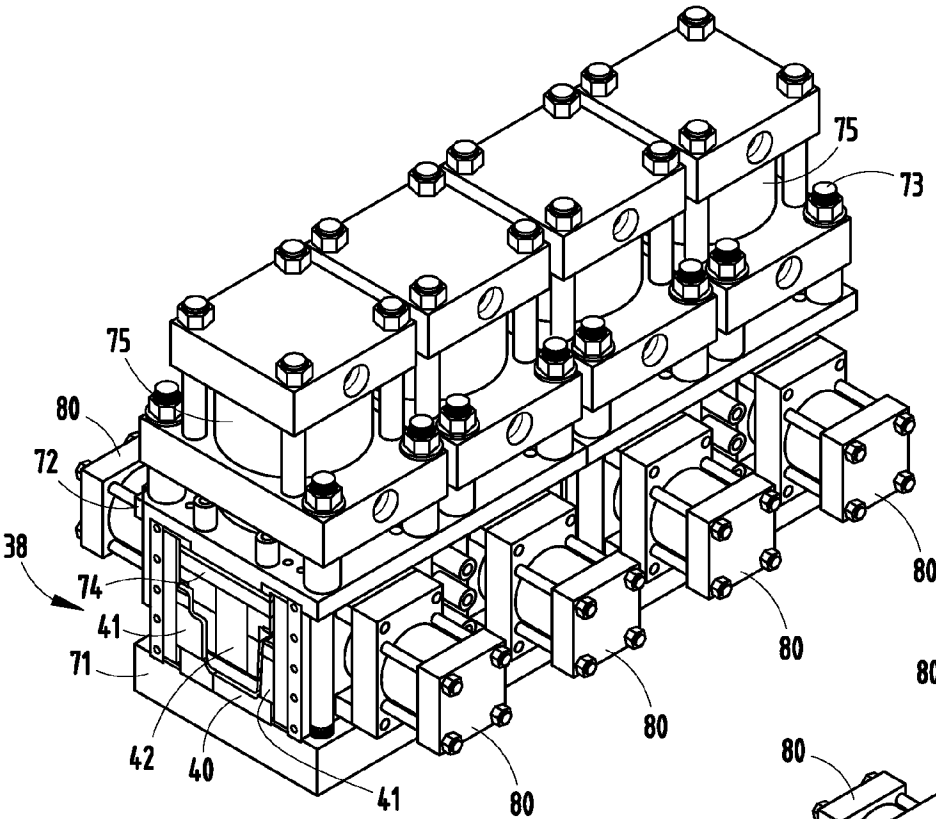
FIG. 5 is an enlarged perspective view of a first couple feet of FIG. 3.
Figure 8:
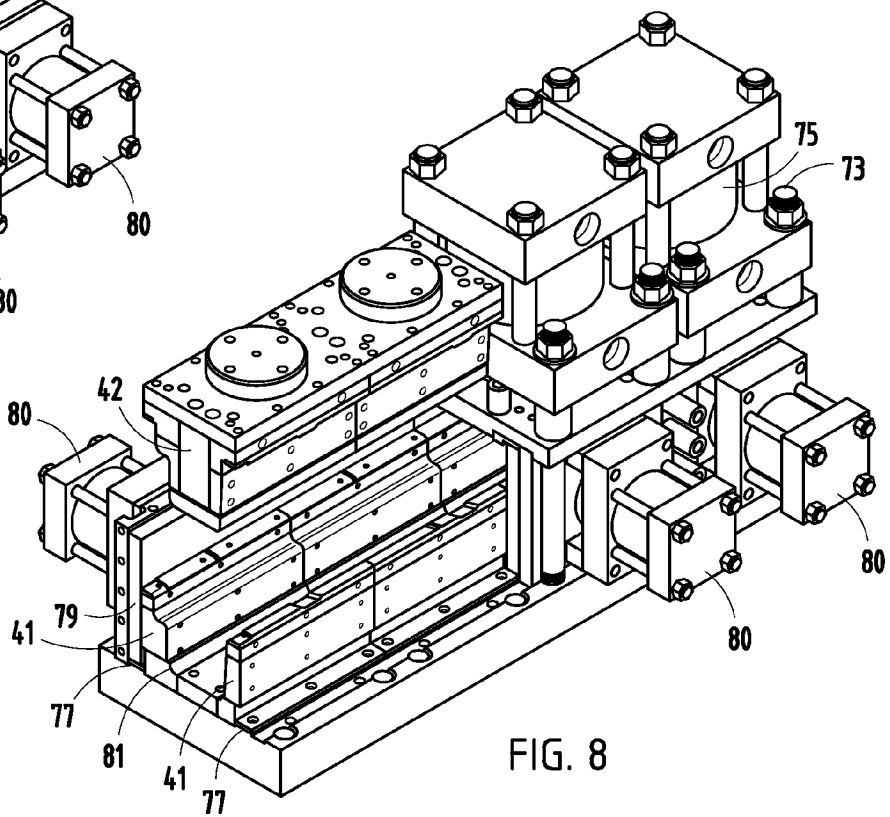
Figure 10:
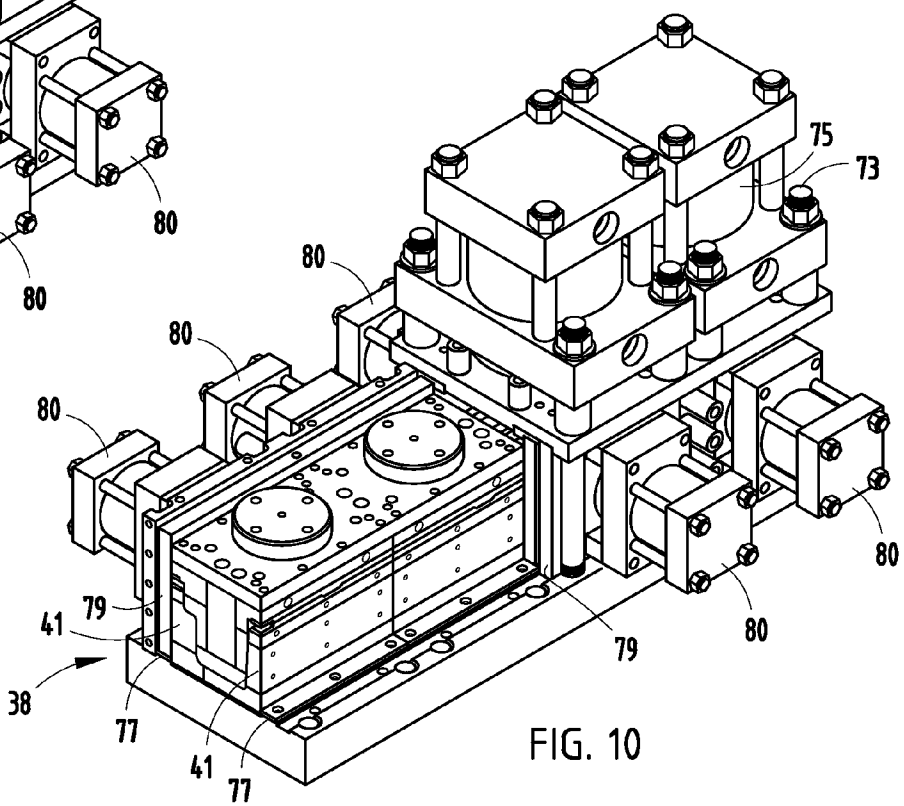
FIG. 10 is similar to FIG. 9, but with the upper form punch/die in a down position.
Figure 9:
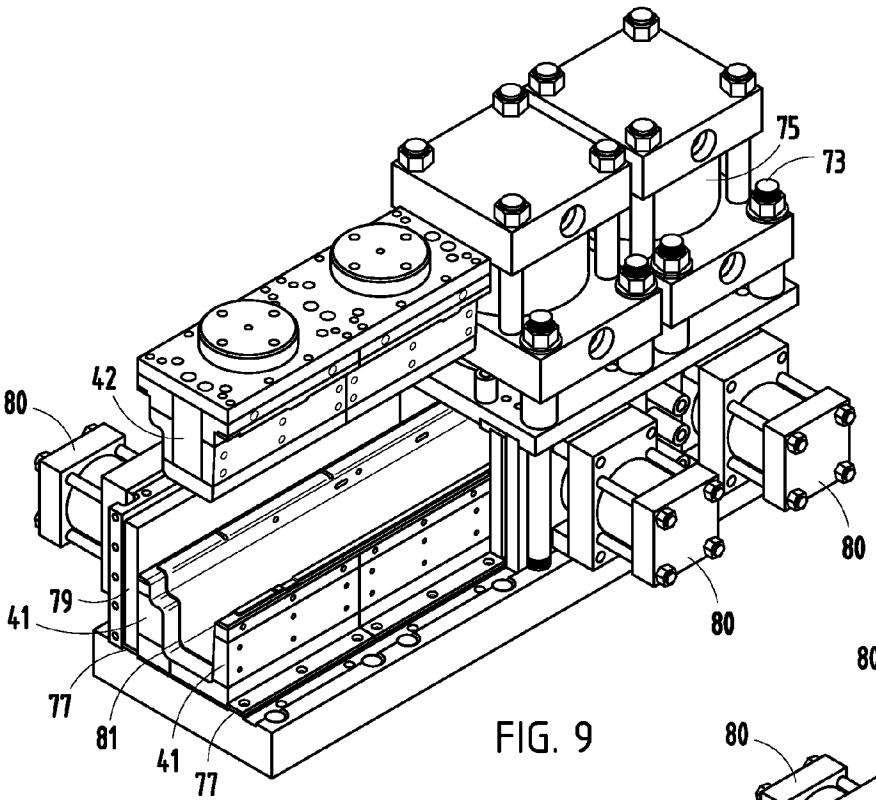
FIG. 9 is similar to FIG. 7, but with the side dies in an inward closed position.

The side dies 41 (FIG. 6) are slidably mounted on the bottom plate 71 of the sled 38 such as by bearings 77. The top plate 72 is located above the movable platen(s) 74 and extends parallel the bottom plate 71. The top plate 72 includes a channel for capturing the top edges of side mounting plates 79, and the bottom plate 71 also includes a similar channel for capturing the bottom edges of the side mounting plates 79. This forms a stationary base to which the side-mounted hydraulic actuators 80 are attached. The side actuators 80 include a rod that extends through the side mounting plates 79 and that is connected to one or more of the side dies 41. FIG. 9 shows the side dies 41 moved to an inward position where they support the sides and flanges of the continuous beam 36. The inward movement of side dies 41 is relatively short, but can be noted by the mismatch at location 81 in FIG. 8, and the alignment in FIG. 9. FIG. 10 shows the top dies 42 (i.e., the "punch" dies) moved to a down position for forming the flanges 50-51 (see FIG. 2). It is contemplated that the dies 41 can also form holes or apertures, and also can deform or punch other parts of the beam 36, such as the bottom wall 46. Notably, the illustrated top dies 42 only need move a short distance, such as a stroke equal to a depth of the depressions 58 plus clearance distance and "overtravel" distance (such as for making holes).

A controller 84 (FIG. 1) is operably connected to the components 31, 33-35, 37, and 44, as well as being operably connected to a hydraulic system 85 for timed motivation of the actuators 70, 75, and 80 for controlling operation of the dies 41-42. It is contemplated that they can be configured and the controller 84 programmed for simultaneous operation as the continuous beam 36 moves along. Alternatively, it is contemplated that only one bank of dies need be operated at a time (such as if only right hand parts are desired).

It is contemplated that the illustrated material can be any suitable material, such as structural steel or higher strength steels.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. An apparatus comprising:

a roll former defining a downstream direction and including rollers configured to form a sheet of metal material into a continuous structural beam having a shaped cross section including at least opposing vertical side walls, a bottom wall, and flanges; and a downstream former positioned in-line and downstream of the roll former, including a die-supporting sled reciprocatingly movable a distance along with the beam, and including on the sled a bottom die supporting a bottom of the beam, opposing side dies slidably supported on the sled and movable in a lateral horizontal direction perpendicular to the downstream direction and reciprocatingly movable inwardly toward the beam to temporarily support sides of the beam, and at least one top die movable vertically against a top of the side dies with the flanges of the beam located therebetween when the side dies are in an inward position, such that the at least one top die is reciprocatingly movable downwardly to engage and reform at least one of the walls and the flanges against at least the side dies.

2. The apparatus defined in claim 1, including a cut off device for cutting the section from the continuous beam.

3. The apparatus defined in claim 1, wherein the continuous beam has a non-symmetrical cross section.

4. The apparatus defined in claim 3, wherein the section of continuous beam is non-symmetrical in length.

5. The apparatus defined in claim 1, wherein the continuous beam is generally U-shaped, but with at least one of the side walls having a non-planar shape.

6. The apparatus defined in claim 1, wherein the flanges have a different deformed shape at one end of the section than at the other end of the section.

7. The apparatus defined in claim 1, wherein the downstream former is configured to make right-hand parts and left-hand parts having different longitudinal shapes.

8. The apparatus defined in claim 1, wherein the downstream former includes a first bank for making right-hand parts, and a second bank for making left-hand parts.

9. The apparatus defined in claim 1, wherein the sled includes two separate sleds, one for each bank.

10. The apparatus defined in claim 1, wherein the sled is adjustably supported for rotation about a centerline extending longitudinally along the continuous beam.

11. The apparatus defined in claim 1, including hydraulic actuators for actuating side and top dies.

12. The apparatus defined in claim 1, including a controller operably connected to the dies for controlled actuation of the dies.

13. An apparatus comprising:

a coil reeler;

a roll feeder for receiving sheet material from the coil reeler;

a pre-pierce press for piercing apertures into the sheet coming from the roll feeder;

a roll former including rollers configured to form the sheet coming from the pre-pierce press into a continuous beam having a continuous cross section;

a downstream former positioned in-line with the roll former, including a first die supporting a bottom of the beam, opposing side dies movable in a lateral horizontal direction perpendicular to a downstream direction and reciprocatingly movable inwardly along a first direction toward the beam to temporarily support sides of the beam, and at least one top die movable vertically against a top of the side dies with the beam located therebetween when the side dies are in an inward position, such that the at least one top die is reciprocatingly movable along a perpendicular second direction to press the continuous beam selectively against the side dies to reform a section of the continuous beam.

14. The apparatus defined in claim 13, including a cut off device for cutting the section from the continuous beam.

15. The apparatus defined in claim 13, wherein the downstream former includes hydraulic actuators for motivating top and side dies.

16. The apparatus defined in claim 13, wherein the first and top dies are moveable along with the beam during reforming the beam.

17. A method comprising steps of:

uncoiling a sheet of material;

pre-piercing the uncoiled sheet;

rollforming the pre-pierced uncoiled sheet with rollers into a continuous beam having a continuous cross section;

providing a downstream former positioned in-line with the roll former;

reforming the pre-pierced uncoiled sheet using the downstream former including supporting a center of the beam, reciprocatingly moving opposing side dies inwardly along a lateral horizontal first direction toward the beam to temporarily support sides of the beam, the first direction being perpendicular to a downstream direction, and reciprocatingly moving a second die along a perpendicular vertical second direction to press the continuous beam selectively against the side dies when the side dies are in an inward position to reform longitudinally-spaced sections of the continuous beam such that transverse cross sections of the beam along a length of the beam are non-uniform.

18. The apparatus defined in claim 1, wherein the bottom, side, and top dies are configured to matably engage a U-shaped structural beam, where the beam has two vertical side walls and a single horizontal bottom wall.

19. The method defined in claim 17, wherein the bottom, side, and top dies are configured to matably engage a U-shaped structural beam, and wherein the step of reforming forms the beam into a U-shaped elongated structure having two vertical side walls and a single horizontal bottom wall.

* * * * *